US005569134A

United States Patent [19]

Nordanger

[11] Patent Number: 5,569,134

[45] Date of Patent: Oct. 29, 1996

[54] COLLAPSIBLE HULA HOOP

[76] Inventor: Synnove Nordanger, Slettevikvn. 37, N-5085 Morvik, Norway

[21] Appl. No.: 337,314

[22] Filed: Nov. 10, 1994

Related U.S. Application Data

[63] Continuation of Ser. No. 768,565, filed as PCT/NO90/00066, Apr. 18, 1990, abandoned.

[30] Foreign Application Priority Data

May 2, 1989 [NO] Norway ..... 891806
Apr. 18, 1990 [WO] WIPO ..... PCT/NO90/00066

[51] Int. Cl.[6] ..... A63H 33/02
[52] U.S. Cl. ..... 482/110; 446/236
[58] Field of Search ..... 446/236, 490; 482/110, 148

[56] References Cited

U.S. PATENT DOCUMENTS

| | | | |
|---|---|---|---|
| 3,079,728 | 3/1963 | Melin | 446/236 |
| 4,380,885 | 4/1983 | Komagata | 446/236 |
| 4,440,391 | 4/1984 | Saenz et al. | 482/110 |
| 4,766,918 | 8/1988 | Odekirk | 135/102 |
| 5,029,847 | 7/1991 | Ross | 482/148 |

FOREIGN PATENT DOCUMENTS

| | | | |
|---|---|---|---|
| 1206458 | 2/1960 | France | 482/110 |
| 2109253 | 6/1983 | United Kingdom . | |

*Primary Examiner*—Stephen R. Crow
*Attorney, Agent, or Firm*—McAulay Fisher Nissen Goldberg & Kiel, LLP

[57] ABSTRACT

A collapsible hula-hoop is formed of a plurality of extruded plastic tube sections which can be bent from a straight shape into an arcuate shape. The individual sections are connected by injection molded connecting joints, each made of a stiffer material than the tube sections. An elastic band is threaded through the tube sections and joints. This band is in a stretched condition with the sections being stacked in parallel and is in a stretched condition with the sections coupled together in an assembled hoop.

4 Claims, 1 Drawing Sheet

COLLAPSIBLE HULA HOOP

This is a continuation of application Ser. No. 07/768,565, filed as PCT/NO90/00066, Apr. 18, 1990, now abandoned.

The present invention relates to a collapsible hula hoop comprising a number of extended separate tube sections, where the one end of each tube section comprises a connecting joint for establishing a connection to an adjacent tube section. According to the invention, the hula hoop is especially applicable as a toy, or as an excercise apparatus during sports and leisure.

The traditional hula hoop is, due to its size and the amount of space it requires, highly unpractical to store and to transport and, moreover, has a very limited application because it is unpractical to bring along with one.

There is therefore a need for a hula hoop or an excercise apparatus of this type that can be collapsed into a more compact unit, so that one can easily bring it with one.

A hula hoop/excercise apparatus of this type is known from UK Patent Application No. 2,109,253. The hoop comprises a number of curved sections which can be assembled to a circular hula hoop. At either end of such curved section is mounted a profiled projection which fits exactly into the corresponding cavities of the adjacent hoop element so that a number of tube sections can be connected to form a complete hoop. The disadvantage with this excercise apparatus, however, is that the connection between the tube sections is weak. Moreover, parts of the hoop may easily be lost when the hoop is disassembled.

The object of the invention is to provide a collapsible hula hoop whereby the abovementioned disadvantages are entirely eliminated.

Briefly, the invention provides a collapsible hula-hoop which is constructed, in part, of a plurality of straight tube sections, each of which is made of a plastic material and which is sized to be bent into an arcuate shape. In one embodiment, the hoop includes a plurality of connecting joints, each of which is made of stiffer material than the tube sections. Also, each joint serves to interconnect adjacent ends of a respective pair of tube sections with the tube sections disposed in an assembled hoop shape.

Still further, the hoop includes an endless elastic band which passes through the tube sections and connecting joints to selectively retain the sections and joints in an assembled hoop shape and in a collapsed state with the tube sections in a parallel array.

According to a preferred embodiment of the hula hoop according to the present invention, the ring consists of a rubber band or of an elastic band.

According to another preferred embodiment of the hula hoop according to the present invention, the connecting joint comprises a separate sleeve body, which has the same or slightly greater external diameter than the tube section's internal diameter $D_i$; and at about the middle of the connecting joint there is formed a peripherally coursed flange having the same external diameter as the tube section. Further, it is preferred according to the invention that the connecting joints are made of a stiffer material than that of the tube sections, and this contributes to the hula hoop maintaining its circular shape in the position of use.

Further features and advantages of the hula hoop according to the present invention will be evident from the following description having regard to the accompanying drawings, in which.

The hula hoop 10 according to the invention comprises a number of separate connectable tube sections 12, 14, 16, 18, 20, 22 where the figure shows six sections. Each tube section has an internal and an external diameter, $D_i$ and $D_y$ respectively. When the hula hoop 10 is assembled, an internal continuous ring-shaped cavity 24 is consequently formed. In the internal cavity 24 is provided an elastic ring 26 which is tightened so that the tube sections 12–22 are held tightly together when the hula hoop is assembled. The tube sections 12–22 may be made of plastic or of other suitable material such as by extruding.

Figure 1:
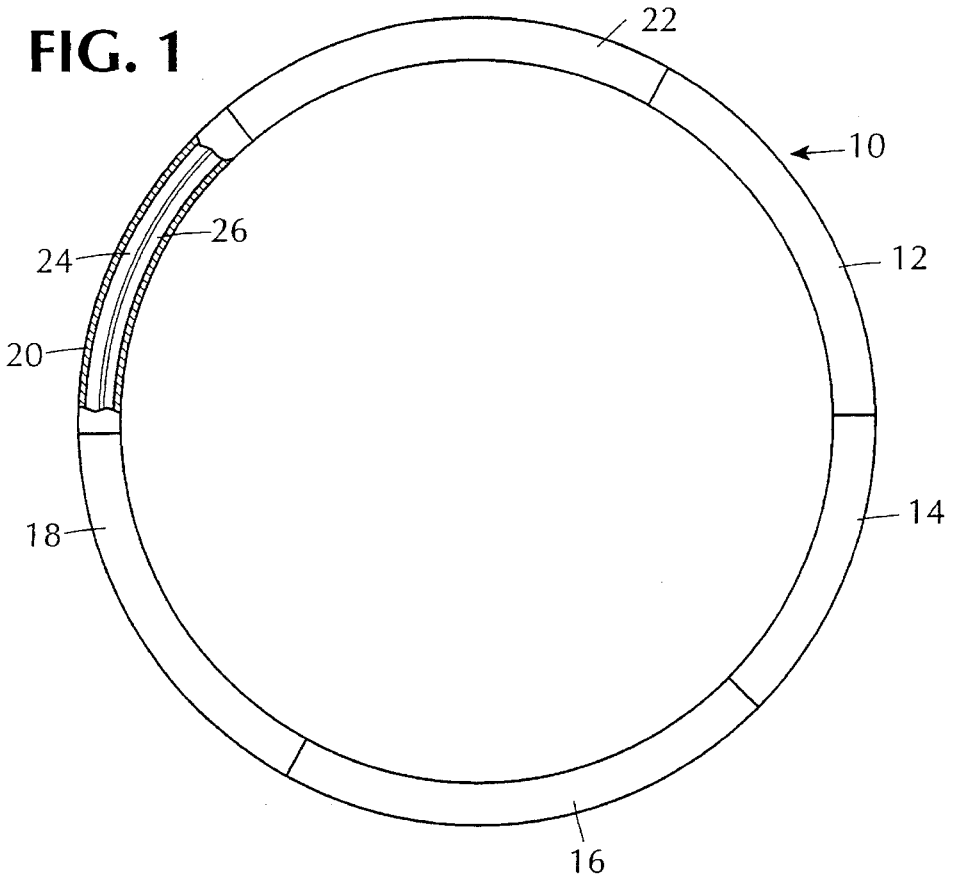
FIG. 1 shows at a reduced scale an assembled hula hoop according to the present invention.
Figure 2:
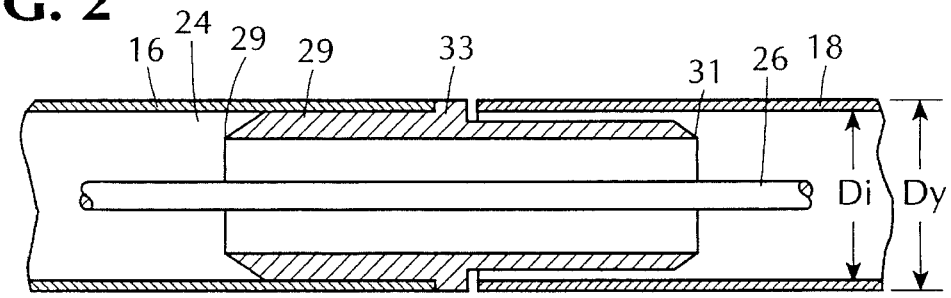
FIG. 2 shows a connecting joint that is provided between two tube sections.

FIG. 2 shows a detail of a preferred embodiment of how two of the adjacent sections (16, 18) of the hula hoop according to FIG. 1 may be connected. In one of the ends of the tube section 16 is installed the one part 29 of a sleeve shaped connecting joint 28, the connecting joint 28 having the same external diameter or slightly greater external diameter than the tube section's internal diameter $D_i$. The connectoing joint 28 may consequently be inserted into the opening of the section 16 and, as a result, adjusts itself to it. The other part 31 of the connecting joint 28 projects outwards from the tube section 16 and consequently adjusts itself to be inserted into the adjacent tube section 18 when the hu! a hoop is to be assembled. (See also FIG. 3). In the middle of the connecting joint 28 is formed a radially coursed ridge or fold 33 having the same external diameter as the tube sections 10–22 external diameter $D_y$. This is particularly preferred during the manufacturing assembly of the said connecting joint 28 into the tube section 16 to ensure that a sufficiently long part of the connecting joint 28 projects out from the end of the tube section 16.

The connecting joint 28 may be made from the same material as the tube sections 12–22 themselves, but is preferably manufactured from a stiffer and harder plastic material than the tube sections, and may adequately be manufactured by way of injection moulding. The fact that the connecting joints 28 are somewhat stiffer than are the section 12–22 contributes to the elements 28 not being able to loosen or falling out from the ring sections once they are assembled. Further, it will contribute to stiffen the hula hoop so that its round shape in user position is maintained.

Because the connecting joint 28 is tubular also, the hula hoop 10 in assembled position forms the abovementioned circular cavity 23 where the elastic ring 26 is provided.

According to an alternative embodiment, as opposed to utilizing separately inserted connecting joints, one of the ends of each tube section is made containing a graded insertion end that fits accurately into an adjacent tube section's opening. It is important that the connecting area between two adjacent tube sections forms a smooth and even surface, without edges or recesses.

The elastic ring 26 comprises preferably a band in the form of an elastic band made of rubber and/or textile. The elastic ring 26 is assembled by being threaded continuously through the tube sections 12–22, whereafter the elastic ends are pulled together and tightened and are joined by way of tying or by way of welding in order to form a continuous band. The elastic ring 26 must be assembled tightly enough so that the tube sections 12–22 in the hula hoop are held sufficiently together during normal use, such as playing and sports activities, i.e. without the tube sections being able to slide away from one another so that gaps are formed between them. The elastic band must not on the other hand, be tighter than that a person with normal excercise of power would be able to pull the tube sections away from one another when the hula hoop is to be disassembled.

Figure 3:
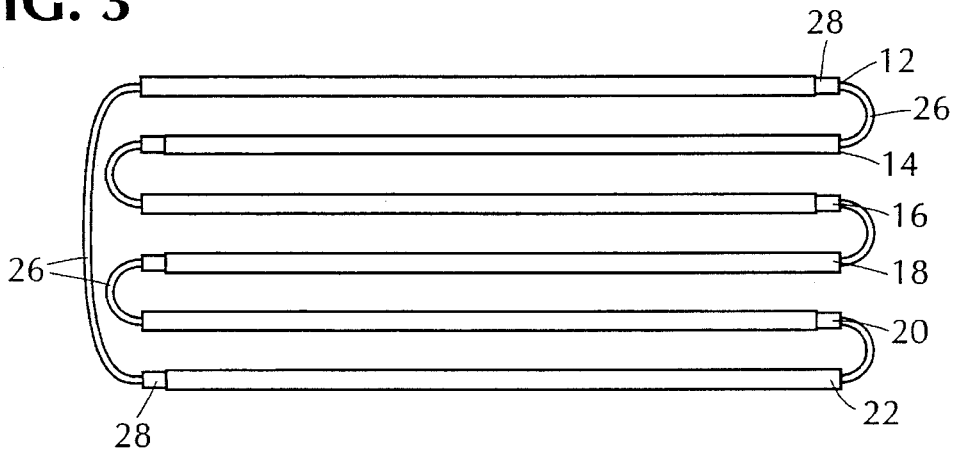
FIG. 3 shows diagrammatically the hula hoop in collapsed position.

In FIG. 3 is shown diagrammatically the hula hoop 10 in collapsed position, and the tube sections 12–22 are now stacked on top of one another. The location of the connecting joints 28 is readily apparent. One will comprehend that the elastic ring 26 is tightened even more when the hula hoop 10 is in a collapsed position than when the hula hoop is in an assembled position. In the figure, it is readily apparent how the elastic ring 30 progresses between each of the tube sections. In the collapsed position, the hula hoop 10 is easy to transport and to store.

A PREFERRED EMBODIMENT

According to a preferred embodiment, the hula hoop according to the invention comprises six tube sections that are manufactured by way of the extruding of a plastic material, and has the total length (circumferences) of about 2.5 meters. The external diameter is 2.0 cm and the tube wall thickness is 1.5 mm. The connecting joints are manufactured by way of injection moulding and, moveover, are manufactured from a harder plastic material than are the tube sections. Moreover, the connecting joints are 6 cm long and the diameter is 1.7 cm, i.e. is equal to the internal diameter of the tube section. There is one connection joint per tube section. In the middle of each connecting joint is made a peripheric-coursed fold with a width equal to 2 mm and with a diameter of 2.0 cm.

The elastic ring in the form of a band of rubber or an elastic textile band, which is run through the tube sections, has a length of about 1.60 meter when it is not extended. This implies that the elastic ring is tighter when the hula hoop is collapsed than when it is assembled in position of use.

I claim:

1. A collapsible hula hoop comprising a plurality of extruded plastic tube sections, each tube section being sized to be bent from a straight shape into an arcuate shape and having one end with a predetermined outside diameter;

a plurality of injection molded connecting joints, each joint being of stiffer material than said tube sections and each joint interconnecting adjacent ends of a respective pair of said tube sections with said tube sections being disposed in an assembled hoop shape, each connecting joint being separately secured in said one end of a respective tube section and slidably received in one end of an adjacent tube section in said assembled hoop shape, each connecting joint having a radially directed flange having an outside diameter equal to said outside diameter of said one of a respective tube section.

2. A hoop as set forth in claim 1 wherein each tube section has an external diameter of 2.0 centimeters and a wall thickness of 1.5 millimeters.

3. An exercise apparatus comprising a plurality of stacked parallel resilient plastic tube sections, each section being sized to be bent from a straight shape to an arcuate shape and having a predetermined outside diameter;

a plurality of injection molded connecting joints, each connecting joint being of a stiffer plastic material than said tube sections, each connecting joint having one part separately secured in one end of a respective tube section, a second part projecting from said respective tube section for insertion in an adjacent tube section and a radial flange between said parts with an external diameter equal to said outside diameter of a respective tube section; and an elastic band threaded through said sections and said joints, said band being of a length less than the total length of said sections whereby said band is in a stretched condition with said sections being stacked in parallel and in a stretched condition with said sections coupled together in an assembled hoop.

4. An exercise apparatus as set forth in claim 3 wherein said tube sections have a total length of 2.5 meters and said band has a length of 1.6 meters.

* * * * *